US007471920B2

(12) United States Patent
Akedo

(10) Patent No.: US 7,471,920 B2
(45) Date of Patent: Dec. 30, 2008

(54) DEVELOPING APPARATUS AND IMAGE FORMING APPARATUS HAVING THE SAME

(75) Inventor: Shuichi Akedo, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 241 days.

(21) Appl. No.: 11/585,330

(22) Filed: Oct. 24, 2006

(65) Prior Publication Data

US 2007/0104515 A1 May 10, 2007

(30) Foreign Application Priority Data

Oct. 24, 2005 (JP) ..... P2005-308991

(51) Int. Cl.
*G03G 15/08* (2006.01)

(52) U.S. Cl. ..... 399/254; 399/258

(58) Field of Classification Search ..... 399/107, 399/111, 119, 120, 252, 254, 255, 258; 222/DIG. 1
See application file for complete search history.

(56) References Cited

U.S. PATENT DOCUMENTS 6,324,369 B1 * 11/2001 Yamaguchi et al. ..... 399/254
6,343,200 B1 1/2002 Hatano et al.
6,415,125 B1 * 7/2002 Yamamoto et al. ..... 399/254
6,421,516 B1 7/2002 Kinoshita et al.
6,985,685 B2 * 1/2006 Shigeta et al. ..... 399/254
7,263,315 B2 * 8/2007 Tanaka et al. ..... 399/254
7,362,989 B2 * 4/2008 Nishihama et al. ..... 399/258
7,376,374 B2 * 5/2008 Adachi ..... 399/254
2005/0281589 A1 12/2005 Sakai et al.

FOREIGN PATENT DOCUMENTS

JP 10-319721 12/1998
JP 2006-006631 1/2002
JP 2006-003524 1/2006

* cited by examiner

*Primary Examiner*—Hoan H Tran
(74) *Attorney, Agent, or Firm*—Nixon & Vanderhye, P.C.

(57) ABSTRACT

There is provided a developing apparatus wherein supplied toner is dispersed properly with agitation so that toner is electrically charged evenly with a constant concentration. The developing apparatus includes a developer container for housing therein a developer containing toner and carrier; a developer carrying body for holding the developer; and agitating/conveying members for conveying the developer with agitation along an axis direction of the developer carrying body. The developer container includes a development region facing the developer carrying body and an extension region formed adjacent in the direction of the developer carrying body in the development region. Also disposed therein is a developer-flow blocking plate acting as a partition between the development region and the extension region.

10 Claims, 5 Drawing Sheets

DEVELOPING APPARATUS AND IMAGE FORMING APPARATUS HAVING THE SAME

CROSS-REFERENCE TO RELATED APPLICATION

This application claims priority to Japanese Patent Application No. JP 2005-308991, which was filed on Oct. 24, 2005, the contents of which, are incorporated herein by reference, in their entirety.

BACKGROUND OF THE INVENTION

1. Field of the Invention

The present invention relates to a developing apparatus for forming an image in an electrophotographic method. More specifically, the present invention relates to a developing apparatus for developing, by using a developer composed of toner and carrier, an electrostatic latent image formed on an image bearing body of a so-called electrophotographic image forming apparatus such as an electrostatic copying machine or a laser beam printer, as well as to an image forming apparatus provided with the developing apparatus.

2. Description of the Related Art

In heretofore conventional image forming apparatuses such as copying machines or printers, development of an electrostatic latent image formed on a photosensitive body acting as an image bearing body is effected with use of toner supplied from a developing apparatus. As typical developing apparatuses designed for use in such image forming apparatuses, there are known a mono-component developer development type of developing apparatus and a dual-component developer development type of developing apparatus. The former employs a developer composed solely of toner, whereas the latter employs a developer composed of toner and carrier.

FIGS. 9 and 10 show an example of a developing apparatus of the type that employs a dual-component developer containing toner and carrier for development.

Broadly speaking, this developing apparatus 100 is composed of: a developer reservoir for storing therein a developer 2 containing toner and carrier; a developing roller 110 arranged face to face with a photoreceptor (photoconductor drum) 1 acting as an image bearing body; and a first agitating/conveying member 150 and a second agitating/conveying member 160 for conveying the developer with agitation, which are arranged side by side on the side opposite from the photoconductor drum 1 and the developing roller 110 arranged in a face-to-face manner.

The developing roller 110 is composed of a rotatably-driven developing sleeve 110*a* formed of a cylindrically shaped non-magnetic member and a magnet member 110*b* disposed inside the developing sleeve 110*a*. The magnet member 110*b* has a plurality of magnetic poles N, S, . . . . The developing sleeve 110*a* constituting the developing roller 110 magnetically attracts the developer at a surface of the developing sleeve 110*a* under a magnetic force of the magnet member 110*b*. Upon driving the developing sleeve 110*a* to rotate in an arrow-indicated direction, the developer thus attracted thereto is conveyed toward a development area where the developing roller 110 and the photoconductor drum 1 confront each other. Following the completion of a development process, the developer is directed into the developer reservoir. The developer 2 is caused to stand magnetically in a spicate or ear-like form at the N pole of the magnet member 110*b*, thereby forming a so-called magnetic brush. The developer rising in the form of magnetic brush is slidingly rubbed against the surface of the photosensitive body 1, so that an electrostatic latent image formed on the photoreceptor 1 is developed by dint of toner.

As the developing sleeve 110*a* is rotated, the developer is conveyed toward the development area opposed to the photoconductor drum 1. In the middle of the conveyance, the amount of the developer is regulated to a predetermined level by a regulating member 170 disposed in the developing apparatus with its front end facing the surface of the developing sleeve 110*a*. That is, the regulating member 170 serves to make substantially uniform the amount of the developer to be conveyed toward the development area opposed to the photoconductor drum 1.

Moreover, the developer reservoir has an upright partition wall 120 formed therein for dividing the interior region in which are disposed the first and second agitating/conveying members 150 and 160 into two sections: a first developer conveyance section 130 and a second developer conveyance section 140. That is, the first agitating/conveying member 150 and the second agitating/conveying member 160 are rotatably driven in the first developer conveyance section 130 and the second developer conveyance section 140, respectively.

The first and second agitating/conveying members 150, 160 are each composed of a rotary shaft 150*a*, 160*a* and a plurality of elliptic bladed members 150*b*, 160*b* spacedly arranged about the rotary shaft 150*a*, 160*a*. The bladed members 150*b*, 160*b* are each inclined relative to the rotary shaft 150*a*, 160*a*. Moreover, as shown in FIG. 10, the partition wall 120 has its lengthwisely opposite ends cut out to create opening portions 120*a* and 120*b* for allowing the passage of the developer in the arrow-indicated directions. Correspondingly, the first and second agitating/conveying members 150, 160 are provided with a bladed member 150*c*, 160*c* facing the opening portion 120*a*, 120*b* at one end thereof, respectively, so that the bladed member 150*c*, 160*c* inclines in the opposite direction to the bladed members 150*b*, 160*b* in order to allow the developer 2 to travel in the arrow-indicated directions smoothly.

In the developing apparatus 100 thus far described, as the first and second agitating/conveying members 150 and 160 are rotated in the first and second developer conveyance sections 130 and 140, respectively, the developer 2 is conveyed in these sections 130 and 140 while being agitated by the bladed members 150*b* and 160*b* of the first and second agitating/conveying members 150 and 160 in a manner such that the toner and carrier contained therein are admixed thoroughly. Note that the developer conveyance direction set for the first developer conveyance section 130 is opposite to that set for the second developer conveyance section 140. At this time, at both ends of the interior region of the developing apparatus 100, the developer 2 is transferred to and fro in circulation between the first developer conveyance section 130 and the second developer conveyance section 140 through the opening portions 120*a* and 120*b* formed on both sides of the partition wall 120. During the developer circulation, in the first developer conveyance section 130, the developer 2 is supplied to the developing roller 110 arranged face to face with the first developer conveyance section 130.

Then, as the developing roller 110 is rotated, as has already been explained, the developer 2 attracted thereto is conveyed toward the development area opposed to the photoconductor drum 1, and, in the middle of the conveyance, the amount of the developer 2 is regulated by the regulating member 170. The toner contained in the developer 2 is used to develop an electrostatic latent image formed on the photoconductor drum 1. In the course of repeated development steps, the concentration of toner contained in the developer 2 is gradually reduced through consumption. In order to give heed to the concentration of toner, for example, a toner concentration sensor is disposed in the apparatus. In response to a detection result, fresh toner is added to the developer 2 on an as needed basis.

Disclosed in Japanese Unexamined Patent Publication JP-A 10-319721 (1998) is a developing apparatus having a mechanism for facilitating the mixing of toner and carrier. In this construction, a developer is circulated by two juxtaposed screws that convey the developer in opposite directions. Toner is added to the developer in a circulating state, whereupon the fresh toner and the carrier contained in the developer are blended with each other. Moreover, at least one of the two screws is provided with a circulating portion for effecting circulation of the carrier and a projection for receiving the toner and conveying it toward the circulating portion. The replenished toner is conveyed by the projection in a direction toward the circulating portion wherein the toner is blended with the carrier contained in the developer. At this time, being conveyed by the projection so as to find its way into the lower part of the circulating developer, the toner can be blended with the carrier contained in the developer satisfactorily.

According to the invention disclosed in JP-A 10-319721, toner is added directly to the developer in a circulating state after a development process. Therefore, if the toner has not been agitated properly until added to the developer, inconveniently, the developer with poorly-charged toner will be supplied to the developing sleeve from the agitating/conveying portion. As a result, the poorly-charged toner is attached to a region other than a image-forming region, thus causing a so-called fogging phenomenon, or the toner is scattered out of the developing apparatus, thus causing a smear in the interior of the image forming apparatus.

In addition, in the invention disclosed in JP-A 10-319721, toner is conveyed to the development area on an as-is basis. It is thus likely that the toner is mixed and dispersed in the developer in an insufficient manner, thus causing lack of uniformity in toner concentration. This gives rise to a problem of uneven density in a resultant image.

SUMMARY OF THE INVENTION

An object of the invention is to provide a developing apparatus capable of being used in a magnetic-brush development manner in a condition that a fresh toner replenished to an existing developer is electrically properly charged before being used for a development process as a consequence of swift and uniform dispersion of the fresh toner replenished to the existing developer in the developing apparatus and thorough agitation of the replenished toner in adding the fresh toner to the existing developer in the apparatus main body.

The invention provides a developing apparatus comprising:

a developer container for housing therein a developer having toner and carrier;

a developer carrying body for holding the developer; and an agitating/conveying member for conveying the developer in circulation along a rotary axis of the developer carrying body with agitation;

wherein the developer container includes a development region facing the developer carrying body and an extension region formed adjacent in the direction of the developer carrying body in the development region, and wherein the developer container has a developer-flow blocking plate acting as a partition between the development region and the extension region.

Thus constructed, in the developing apparatus, since supplied toner is swiftly dispersed uniformly in the entire developer housed in the apparatus main body, it never occurs that a part of the developer located in a certain area exhibits an extremely high toner concentration. As another advantage, supplied toner is agitated with the developer thoroughly and is thus electrically charged in an appropriate manner. This makes it possible to prevent occurrence of a so-called fogging phenomenon in a resultant image due to poorly-charged toner, as well as occurrence of a smear in the interior of an image forming apparatus having the developing apparatus due to spatters of toner coming from the developing apparatus.

In the invention, it is preferable that the development region and the extension region separated by the developer-flow blocking plate are provided with the agitating/conveying member for conveying the developer in circulation.

In the invention, it is preferable that the agitating/conveying member is provided integrally through the development region and the extension region.

In the invention, it is preferable that two agitating/conveying members for conveying the developer in opposite directions each other are provided in order to convey the developer in circulation, wherein a partition wall is provided between the agitating/conveying members in each of the development region and the extension region, and wherein the agitating/conveying members convey the developer in opposite directions each other along the partition wall so that the developer is circulated.

In the invention, it is preferable that a toner supply unit is provided on the developer container at a position corresponding to the extension region.

In the invention, it is preferable that the extension region is located downstream of a direction in which the developer is conveyed by the agitating/conveying member facing the developer carrying body.

In the invention, it is preferable that the agitating/conveying member is provided with an agitating member in a spiral configuration.

In the invention, it is preferable that one end of the developer-flow blocking plate is located inwardly of an outer periphery of one agitating/conveying member, and another end of the developer-flow blocking plate is located inwardly of an outer periphery of another agitating/conveying member.

In the invention, it is preferable that the developer-flow blocking plate has an opening through which the agitating/conveying member extends, and the opening is formed so as to have an inner diameter thereof larger than an outer diameter of the agitating/conveying member.

The invention provides an image forming apparatus having any one of the above-described developing apparatuses.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
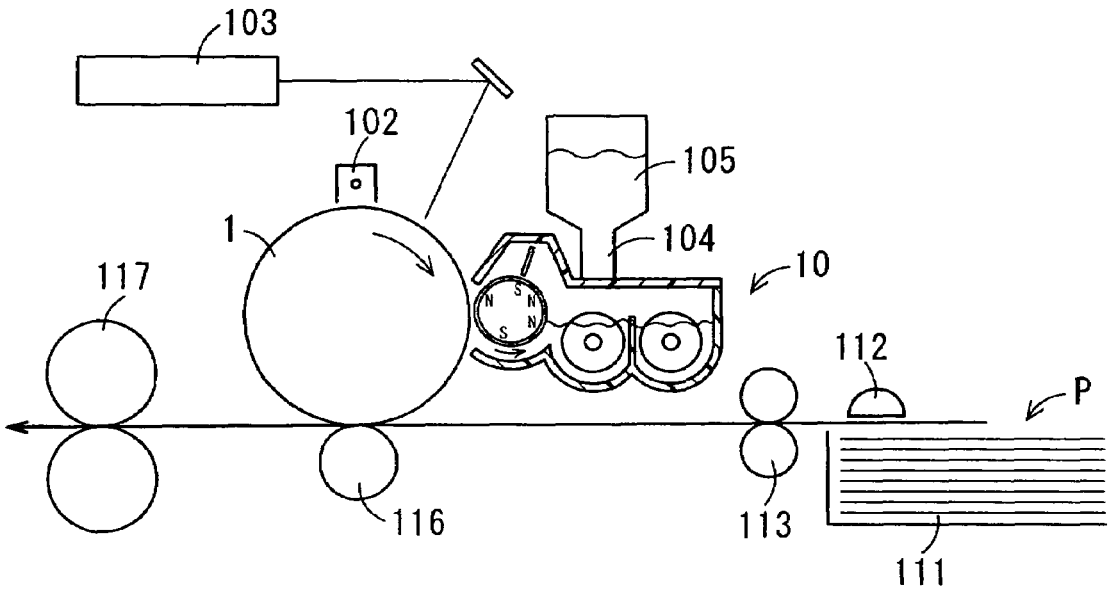
FIG. 1 is a constitutional diagram showing an example of an image forming apparatus to which is applied a developing apparatus according to one embodiment of the invention.

Now referring to the drawings, preferred embodiments of the invention are described below.

Hereinafter, a developing apparatus embodying the invention will be described with reference to the accompanying drawings. It should be noted that the following embodiments of the invention will be considered in all respects as illustrative only and not restrictive of the technical scope of the invention.

FIG. 1 is a view schematically showing the structure of an image forming apparatus that employs the developing apparatus according to the invention. The image forming apparatus depicted in FIG. 1 is designed to produce toner image output on a paper sheet used as a recording medium in an electrophotographic image formation process. However, the application of the invention is not limited to such an image forming apparatus. For example, the invention is applicable to any given image forming apparatus so long as it is designed to effect image formation by using a method involving a step of forming a latent image on an image bearing body by means of electrophotography or electrostatic recording, and a step of developing the latent image with use of a dual-component type developer.

First of all, the electrophotographic image forming apparatus shown in FIG. 1 includes a cylindrically shaped electrophotographic photoreceptor, namely a photoconductor drum 1 acting as an image bearing body. The photoconductor drum 1 is driven to rotate in an arrow-indicated direction. On the photoconductor drum 1 is formed an electrostatic latent image by latent image forming means. More specifically, the photoconductor drum 1 has its surface electrically charged at a predetermined potential by an electrical charger 102. The electrically charged surface of the photoconductor drum 1 is exposed to light by exposure unit 103. The exposure unit 103 performs light exposure on the surface of the photoconductor drum 1 through the radiation of a light image from a semiconductor laser which is controlled in accordance with image information, for example. The electrical charger 102 and the exposure unit 103 constitute latent image forming means.

Upon the completion of the exposure process, an electrostatic latent image corresponding to image information is formed on the surface of the photoconductor drum 1. The electrostatic latent image formed on the photoconductor drum 1 is then visualized (developed) into a toner image by a developing apparatus 10 implemented by way of one embodiment of the invention. The toner image formed on the photoconductor drum 1 is transferred onto a paper sheet which is fed at a predetermined timing from paper feeding mechanism composed of a paper feeding cassette 111, a paper feeding roller 112, and a pair of resist rollers 113.

In the area where the toner image is transferred is disposed a transfer roller 116 acting as transfer unit. That is, the transfer roller 116 and the photoconductor drum 1 are arranged in a face-to-face manner, with the toner-image transfer area lying therebetween. A paper sheet P housed in the paper feeding cassette 111 is transported to the toner-image transfer area at a predetermined timing by the aforementioned paper feeding mechanism. In this way, the toner image formed on the surface of the photoconductor drum 1 is transferred onto the paper sheet P by the action of the transfer roller 116.

After that, the paper sheet P is moved away from the photoconductor drum 1 and transported to a fixing device 117. For example, the fixing device 117 is composed of a heating roller and a pressurizing roller. The heating roller is heated at a predetermined temperature so as for toner to be fused into place on the paper sheet. The pressurizing roller is brought into contact with the heating roller under pressure, for pressing the toner image borne on the paper sheet P against the heating roller. In the fixing device 117, the toner image remaining unfixed on the paper sheet P is fixed thereon through application of heat and pressure. The paper sheet P on which is fixed the toner image is eventually ejected out of the image forming apparatus.

Moreover, disposed adjacent to the developing apparatus 10 is a toner supply unit 105 for replenishing the developing apparatus 10 with toner. The toner supply unit 105 communicates with a developer container 9 for housing therein a developer disposed in the developing apparatus 10 through a toner supply inlet 104 of the developer container 9. By operating the toner supply unit 105 in a predetermined manner, it is possible to replenish the developing apparatus 10 with toner. More details thereof will be given later on.

Figure 2:
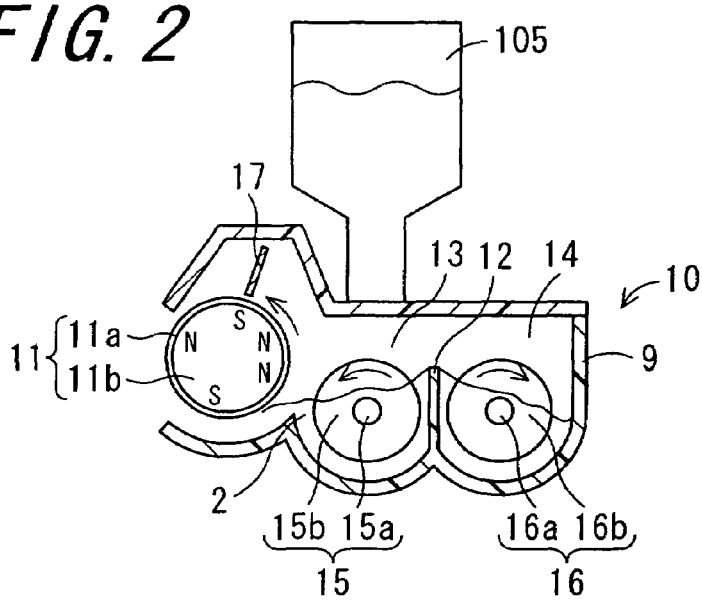
FIG. 2 is a sectional view showing the structure of the developing apparatus.

FIG. 2 is a schematic constitutional diagram of the developing apparatus 10 according to one embodiment of the invention. The developing apparatus 10 of the present embodiment is built as a dual-component developer contact development type of developing apparatus (a dual-component magnetic brush development type developing apparatus). Specifically, the developing apparatus 10 is mainly composed of the developer container 9 for housing therein a developer 2 containing toner and carrier. The developer container 9 has an opening formed face to face with the photoconductor drum 1. Around the opening is disposed, as a developer carrying body, a developing roller 11 which is made freely rotatable in an arrow-indicated direction as shown in FIG. 2. The developing roller 11 includes a rotatably-driven developing sleeve 11*a* formed of a cylindrically shaped non-magnetic member. The developing sleeve 11*a* includes a stationary magnet roller 11*b* provided with a plurality of magnetic poles. The magnet roller 11*b* acts as magnetic field generating means. The developing sleeve 11*a* is capable of magnetically attracting and retaining toner-holding carrier at its surface under a magnetic force exerted by the stationary magnet roller 11*b*.

Moreover, as developer layer thickness regulating means, a doctor blade 17 is disposed face to face with the developing sleeve 11*a*, with a predetermined spacing secured therebetween. As the developing sleeve 11*a* is rotated in the arrow-indicated direction, the doctor blade 17 controls the layer thickness (or the amount) of a developer which is conveyed while being attracted onto the developing sleeve 11*a* to form a thin layer of the developer. The developing sleeve 11*a* is arranged with a predetermined spacing away from the photoconductor drum 1. The developing sleeve 11*a* is so designed that, following the completion of developer layer formation on the developing sleeve 11*a* by the doctor blade 17, the developer makes contact with the photoconductor drum 1. On the surface of the developing sleeve 11*a* facing the photoconductor drum 1 in particular, the developer is caused to stand magnetically in a spicate or ear-like form at the N pole of the magnet roller 11*b* included therein, thereby forming a magnetic brush. The developer rising in the form of magnetic brush is slidingly rubbed against the surface of the photoconductor drum 1, whereupon the toner is moved to an electrostatic latent image formed on the photoconductor drum 1 to form a toner image.

After that, the developer returns into the developer container 9 as the developing sleeve 11*a* is rotated, and is then stripped off from the developing sleeve 11*a* at the location where the same magnetic poles, namely the N poles of the magnet roller 11*b* are adjacent to each other (refer to FIG. 2). The developer removed from the developing sleeve 11*a* is mixed into the developer existing in the developer container 9. In so doing a fresh developer is conveyed to the doctor blade 17 acting as developer layer thickness regulating means to form a thin layer of the developer on the developing sleeve 11*a* in preparation for the next development process.

In order to supply the developer to the developing sleeve 11*a*, two pieces of agitating means: a first agitating/conveying member 15 and a second agitating/conveying member 16 are disposed inside the developer container 9. The first and second agitating/conveying members 15 and 16 are arranged in parallel with a rotary axis of the developing sleeve 11*a* at the back of the developing sleeve 11*a*, namely on one side of the developing sleeve 11*a* opposite to the other side facing the photoconductor drum 1. Moreover, at a bottom of the developer container 9 is formed an upright partition wall 12 for separating the first and second agitating/conveying members 15 and 16. By disposing the upright partition wall 12 in the developer container 9, it is possible to create a first developer conveyance section 13 and a second developer conveyance section 14 for conveying the developer in circulation. The first agitating/conveying member 15 and the second agitating/conveying member 16 are disposed in the first developer conveyance section 13 and the second developer conveyance section 14, respectively.

Figure 3:
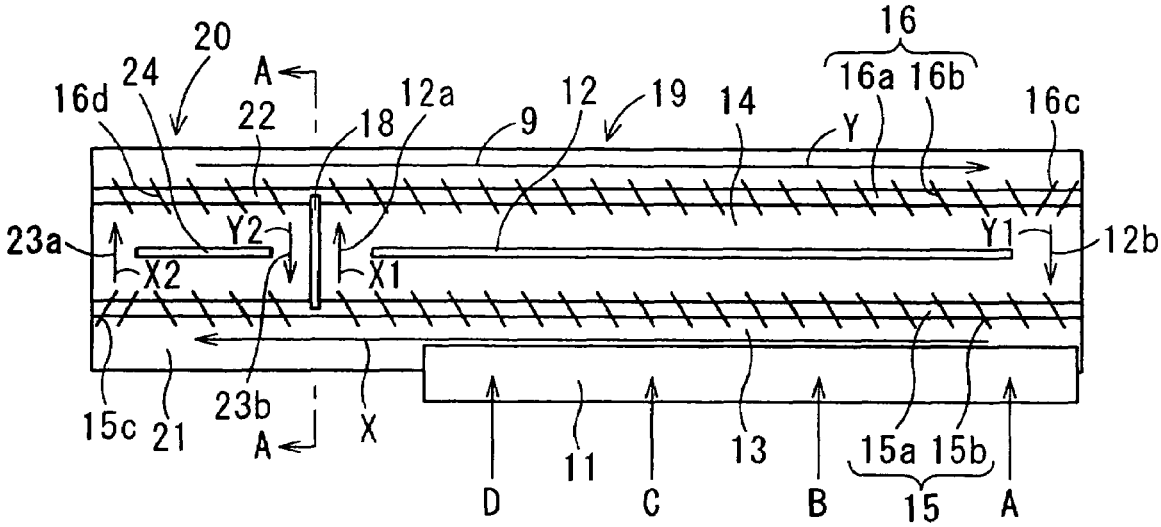
FIG. 3 is a plan view showing the structure of the developing apparatus.

The first and second agitating/conveying members 15 and 16 are substantially identical in structure. As shown in FIG. 3, the first agitating/conveying member 15 is composed of a rotary shaft 15*a* and a plurality of elliptic bladed members 15*b*. Likewise, the second agitating/conveying member 16 is composed of a rotary shaft 16*a* and a plurality of elliptic bladed members 16*b*. The plurality of elliptic bladed members 15*b*, 16*b* are arranged spacedly about the rotary shaft 15*a*, 16*a*, respectively, in a spiral configuration. Instead of such a bladed member 15*b*, 16*b*, it is also possible to use a screw-like component shaped in a continuous spiral configuration. It is needless to say that any other configuration can be adopted so long as it allows the developer to be conveyed while being agitated properly.

As shown in FIG. 3, in the present embodiment of the invention, the developer container 9 includes, independently of a development region 19 confronted by the developing roller 11, an extension region 20 formed by elongating one end of the development region 19 along the direction of a rotary axis of the first, second agitating/conveying member 15, 16. The extension region 20 is provided as an additional agitation region for mixing and agitating supplied toner with the developer.

In the developer container 9 including the development region 19 and the extension region 20 which is of an integral continuation thereof, like the development region 19, the extension region 20 is provided with a first extended developer conveyance section 21 and a second extended developer conveyance section 22 that communicate with the first developer conveyance section 13 and the second developer conveyance section 14, respectively. In order to separate the first and second extended developer conveyance sections 21 and 22, a partition wall 24 analogous to the partition wall 12 is formed in the extension region 20 so as to stand uprightly from the bottom of the developer container 9.

As shown in FIG. 3, the first and second agitating/conveying members 15 and 16 are so formed as to extend into that part of the developer container 9 which includes the first and second extended developer conveyance sections 21 and 22. In other words, the first agitating/conveying member 15 which is located in the first extended developer conveyance section 21 is an integral continuation of that located in the first developer conveyance section 13, and the second agitating/conveying member 16 which is located in the second extended developer conveyance section 22 is an integral continuation of that located in the second developer conveyance section 14.

Also disposed in the developer container 9 is a developer-flow blocking plate 18 which is formed between the development region 19 and the extension region 20 so as to be perpendicular to the partition walls 12 and 24, namely perpendicular to the rotary shaft. The developer-flow blocking plate 18 acts as a partition between the development region 19 confronted by the developing sleeve 11*a* for effecting a development process and the extension region 20 which plays a different role. A part of the developer is stemmed by the developer-flow blocking plate 18 during conveyance.

The partition wall 12 is disposed to separate the first agitating/conveying member 15 and the second agitating/conveying member 16, thereby creating the first developer conveyance section 13 and the second developer conveyance section 14. This helps prevent the developer from being fed to the first and second developer conveyance sections 13 and 14 in a straightforward manner. The partition wall 12 has its lengthwisely opposite ends cut out to create opening portions 12*a* and 12*b* that are located at both ends of the development region 19 confronted by the developing roller 11.

Moreover, as has already been mentioned, in the extension region 20 is disposed the second partition wall 24 which plays substantially the same role as the partition wall 12. The second partition wall 24 is formed in the developer container 9 so as to lie between the first agitating/conveying member 15 and the second agitating/conveying member 16. The second partition wall 24 is provided to prevent the developer from being fed to the first and second extended developer conveyance sections 21 and 22 in a straightforward manner. Similarly, the second partition wall 24 has its lengthwisely opposite ends cut out to create opening portions 23*a* and 23*b* for allowing the passage of the developer.

As described hereinabove, the developer container 9 is provided with the partition walls 12 and 24 and the developer-flow blocking plate 18. In this structure, as the first and second agitating/conveying members 15 and 16 are rotated, the developer is conveyed to and fro in circulation between the first and second developer conveyance sections 13 and 14 as well as between the first and second extended developer conveyance sections 21 and 22. The process of developer conveyance will be explained below with reference to FIG. 3.

At first, in the first developer conveyance section 13, the developer 2 is conveyed while being agitated in a direction indicated by an arrow X as the first agitating/conveying member 15 is rotated. The developer 2 is partly stemmed at the developer-flow blocking plate 18 during conveyance. The stemmed part of the developer 2 makes a turn at the opening portion 12*a* to travel in a direction indicated by an arrow X1 toward the second agitating/conveying member 16 in the second developer conveyance section 14. On the other hand, the other part of the developer 2 continues to travel in the X direction to reach the first extended developer conveyance section 21 in the extension region 20.

The developer that reached the second developer conveyance section 14 is then conveyed while being agitated in a direction indicated by an arrow Y as the second agitating/conveying member 16 is rotated in a direction reverse to the rotation direction of the first agitating/conveying member 15. The developer, now traveling in the Y direction, makes a turn at one end of the developer container 9 to pass through the opening portion 12*b* of the partition wall 12, and travels in a direction indicated by an arrow Y1 to reach the first developer conveyance section 13 to which the first agitating/conveying member 15 belongs. Through a repeat of this conveyance process, the developer can be conveyed in circulation within the development region 19 of the developer container 9.

On the other hand, the developer that reached the first extended developer conveyance section 21, now traveling in the X direction, makes a turn at the other end of the developer container 9 to pass through the opening portion 23*a*, and travels in a direction indicated by an arrow X2 to reach the second extended developer conveyance section 22 to which the second agitating/conveying member 16 belongs. Then, the developer is further conveyed in the Y direction by the second agitating/conveying member 16, with a part of which stemmed by the developer-flow blocking plate 18. The stemmed part of the developer is caused to pass through the opening portion 23*b* facing the developer-flow blocking plate 18, and travels in a direction indicated by an arrow Y2 to return to the conveyance section to which the first agitating/conveying member 15 belongs. In this way, the developer 2 is conveyed within the extension region 20 so as to follow the circulation route described just above.

The supply of toner is effected by the aforesaid toner supply unit 105 at the location of the extension region 20. Particularly, the toner supply inlet 104 of the toner supply unit 105 is disposed face to face with the first extended developer conveyance section 21 of the extension region 20. The toner supply unit 105 may be of a conventionally known type that operates in response to the detection of lack of toner concentration provided by a toner concentration sensor. For example, the toner housed in the toner supply unit 105 is fed, through the toner supply inlet 104, into the first extended developer conveyance section 21 in accompaniment with the rotation of a supply roller or the like component. In this way, the supplied toner is added to the developer 2, and the toner and the developer 2 are mixed and agitated together.

The developer is fed from one conveyance section to which the first agitating/conveying member 15 belongs to the other conveyance section to which the second agitating/conveying member 16 belongs, and vice versa, at the opening portion 12*b* of the partition wall 12 and the opening portion 23*a* of the second partition wall 24 that are located at both ends of the developer container 9. In order to achieve the circulation of the developer in an efficient manner, as shown in FIG. 3, the first agitating/conveying member 15 and the second agitating/conveying member 16 have a bladed member 15*c* and a bladed member 16*c*, respectively, that are located face to face with their corresponding opening portions 12*b* and 23*a*. The bladed member 15*c*, 16*c* is shaped differently from the bladed members 15*b*, 16*b* and inclined in the opposite direction to the bladed member 15*b*, 16*b*. Also in the case of employing the spiral screw structure instead of the bladed structure, the first and second agitating/conveying members 15 and 16 assume such a configuration as described just above.

Figure 4:
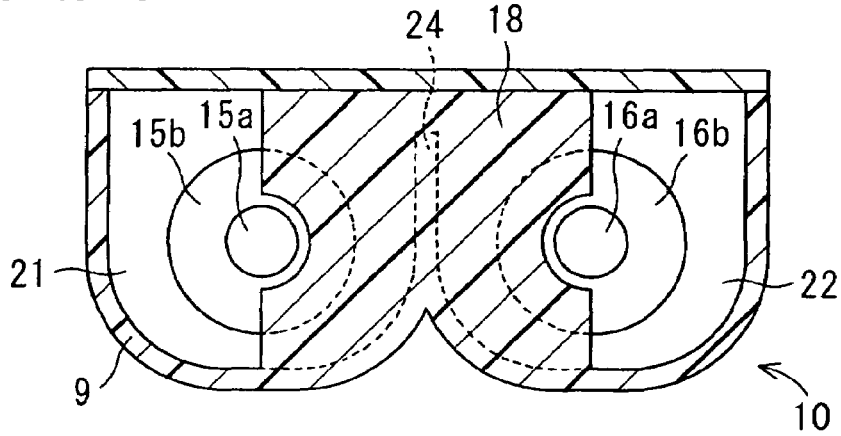
FIG. 4 is a sectional view taken along the line A-A of FIG. 3, illustrating an example of the configuration of a developer-flow blocking plate.

FIG. 4 is a sectional view taken along the line A-A of FIG. 3, illustrating an example of the configuration of the developer-flow blocking plate 18 according to the invention. The developer-flow blocking plate 18 is so disposed as to cover approximately half of the circular area of the bladed member 15*b*, 16*b* of the first, second agitating/conveying member 15, 16 as projected on a virtual plane which is perpendicular to the axis of the first, second agitating/conveying member 15, 16. In other words, the developer-flow blocking plate 18 is so disposed as to cover approximately one-half of the bladed member 15*b* of the first agitating/conveying member 15 and one-half of the bladed member 16*b* of the second agitating/conveying member 16 that are adjacent to each other.

Thus, as shown in FIG. 4, the developer-flow blocking plate 18 is partly cut away at the opposite edges facing the shafts 15*a* and 16*a*, respectively. That is, the edge of the developer-flow blocking plate 18 is located radially inwardly of the outer periphery of a circle defining the bladed member 15*b*, 16*b* as projected on the developer-flow blocking plate 18. In so doing the widthwisely (horizontally, when viewed in FIG. 4) opposite edges of the developer-flow blocking plate 18 and their corresponding side walls of the developer container 9 extending in a direction parallel to the developer conveyance direction constitute openings. Through these openings, the first developer conveyance section 13 communicates with the first extended developer conveyance section 21, and the second developer conveyance section 14 communicates with the second extended developer conveyance section 22.

Thus, the developer-flow blocking plate 18 has its one edge located radially inwardly of the outer periphery of the circle defining the bladed member 15*b* of the first agitating/conveying member 15 passing across the first developer conveyance section 13 and the first extended developer conveyance section 21, and the other end located radially inwardly of the outer periphery of the circle defining the bladed member 16*b* of the second agitating/conveying member 16 passing across the second developer conveyance section 14 and the second extended developer conveyance section 22. This configuration ensures the following advantageous effects of the invention.

During conveyance toward the developer-flow blocking plate 18, the developer being conveyed by the first agitating/conveying member 15 in the first developer conveyance section 13, as well as the developer being conveyed by the second agitating/conveying member 16 in the second extended developer conveyance section 22, comes into collision with the developer-flow blocking plate 18 without fail. At this time, the developer is divided up, thereby enhancing the effect of agitation (hereafter referred to as dividedly agitated effect). More specifically, through the collision against the developer-flow blocking plate 18, the developer 2 is divided into two portions, thereby facilitating the mixing and agitation of the developer. In this case, fresh toner which has been supplied into the first extended developer conveyance section 21 of the extension region 20 can be swiftly dispersed in the developer 2, and used developer which has been fed into the extension region 20 after being released from the surface of the developing roller 11 can also be swiftly dispersed in the developer.

Moreover, by adjusting the degree to which one edge of the developer-flow blocking plate 18 is partly indented radially inwardly of the outer periphery of the circle defining the bladed member 15*b* (the location of one edge of the developer-flow blocking plate 18), it is possible to optimize the amount of used developer released from the surface of the developing roller 11 that will be returned to the extension region 20 (the amount of used developer which has not been stemmed by the developer-flow blocking plate 18). On the other hand, by adjusting the degree to which the other edge of the developer-flow blocking plate 18 is partly indented radially inwardly of the outer periphery of the circle defining the bladed member 16*b* of the second agitating/conveying member 16, it is possible to optimize the amount of the mixedly agitated developer that will be fed into the development region 19, with its toner concentration increased by the toner supplied by way of the extension region 20.

Note that, referring to FIG. 3, in order to dispose the developer-flow blocking plate 18 having the configuration as shown in FIG. 4, that part of the first, second agitating/conveying member 15, 16 which is opposed to the developer-flow blocking plate 18 is free of the bladed members 15*b*, 16*b*. In this blade absent area, the developer being conveyed is restrained from further movement and is thus pressed against the developer-flow blocking plate 18 by successive inflows of other developer. As the result of the collision, one of the divided portions of the developer is fed into the development region 19 or the extension region 20. This helps enhance the dividedly agitated effect.

As described hereinabove, in the developing apparatus 10 according to one embodiment of the invention, the developer container 9 has the development region 19 confronted by the developing roller 11 for effecting conveyance of the developer in circulation, and the extension region 20 formed so as to extend beyond the development region 19 in the direction in which the developer is conveyed by the first agitating/conveying member 15. Separation between the development region 19 and the extension region 20 is achieved by the developer-flow blocking plate 18 for blocking the flow of the developer in part. By disposing the developer-flow blocking plate 18, it is possible to constitute the developer circulation route as described thus far. The developer being conveyed within the development region 19 comes into collision with the developer-flow blocking plate 18 and it is thereupon divided into two portions, one portion of which is circulated in the same region, and the other portion is fed into the extension region 20. Likewise, the developer being conveyed within the extension region 20 comes into collision with the developer-flow blocking plate 18 and it is thereupon divided into two portions, one portion of which is circulated in the same region, and the other portion is fed into the development region 19. At this time, through the collision against the developer-flow blocking plate 18, the flow of the developer is divided, thereby facilitating the mixing and agitation of the developer.

Accordingly, upon supplying toner into the extension region 20, the supplied toner is mixed and dispersed in the developer in an efficient manner. Moreover, since the toner and the developer are agitated together thoroughly in the extension region 20, it follows that the toner can be fed into the development region 19 in a state of readiness to be electrically charged sufficiently. As a result, the toner has been dispersed evenly in the developer until supplied to the developing roller 11, wherefore a fully-charged toner can be used for a development process. This makes it possible to achieve development successfully with uniform toner concentration.

The Exemplary Extension Region 20 in the Developer Container 9

In the developing apparatus 10 set forth hereinbefore, by imparting as long a length as possible to the extension region 20 in the developer conveyance direction, the likelihood is that the effect of agitation will be enhanced. However, if the length of the extension region 20 is too long, the developing apparatus 10 is unnecessarily increased in length in the developer conveyance direction correspondingly. As a result, the image forming apparatus must have extra space for accommodating the developing apparatus 10. By way of contrast, if the length of the extension region 20 is short, it becomes impossible to obtain a satisfactory agitation effect.

In light of the foregoing, it is preferable that the length of the extension region 20 is set to 15% or more of the total length of a combination of the development region 19 and the extension region 20. This makes it possible to obtain both of the effect of agitating the developer during conveyance in the extension region 20 by the first and second agitating/conveying members 15 and 16 (hereafter referred to as transportedly agitated effect) and the dividedly agitated effect brought about by the developer-flow blocking plate 18. If the length of the extension region 20 is less than 15%, the transportedly agitated effect is significantly decreased, and thus the dividedly agitated effect is the only advantage that can be gained. That is, there is no excellent synergy between the two effects, with the result that the developer fails to spread out evenly in the interior of the developing apparatus. Although the above-described agitation effects can be sufficiently achieved by setting the length of the extension region 20 at or above 15%, an excessive increase in the length of the extension region 20 necessitates extra space in the image forming apparatus. Accordingly, by adjusting the length of the extension region 20 to 20% or less of the total length, not only it is possible to avoid creation of wasted space but it is also possible to exert the effects of agitating and dispersing the developer in an efficient manner.

Another Example of the Structure of the Developing Apparatus 10

In order to enhance the effect of conveying developer with agitation, the first agitating/conveying member 15 and the second agitating/conveying member 16 are each designed to rotate in a predetermined direction such as to let the developer come from the bottom of the developer container 9 to the partition wall 12, 24 during conveyance. This makes it possible to facilitate the mixing and circulation of the developer. For example, in a case where the first and second agitating/conveying members 15 and 16 are driven to rotate in the arrow-indicated different directions as shown in FIG. 2, the developer 2 being conveyed by the first agitating/conveying member 15 and the developer 2 being conveyed by the second agitating/conveying member 16 are each brought to the first partition wall 12.

The amount of developer to be charged into the developer container 9 of the developing apparatus 10 is adjusted in a manner such that, referring to FIG. 2 for example, 50% to 100% of the external diametric or cross-sectional profile of each of the bladed members (screw members) 15*b* and 16*b* is covered with the developer 2, when viewed in a heightwise direction (vertical direction, in FIG. 2), under the condition where the first and second agitating/conveying members 15 and 16 are kept in a non-rotated state. The reason for such a developer-amount adjustment will be stated hereunder.

If the developer is supplied in an amount such as to cover less than 50% of the external diametric or cross-sectional profile of each of the bladed members 15*b* and 16*b* of the first and second agitating/conveying members 15 and 16, the amount of the developer fed to the developing roller 11 from the first agitating/conveying member 15 becomes insufficient, thus leaving a trace of the configuration of the bladed member 15*b* or screw member acting as the agitating means of the first agitating/conveying member 15 in the developer borne on the surface of the developing roller 11. This leads to an image imperfection.

By way of contrast, if the developer is supplied in an amount such as to cover greater than 100% of the external diametric or cross-sectional profile of each of the bladed members 15*b* and 16*b* of the first and second agitating/conveying members 15 and 16, the toner supplied into the extension region 20 cannot be dispersed properly in the developer 2. Therefore, the toner is conveyed while moving as if to slide over the top portion of the developer, and eventually fed to the developing roller 11 in an unagitated state. This gives rise to an imperfection in an image such as a fogging phenomenon.

It will thus be seen that an image of high quality can be produced by setting the level of developer to be supplied into the developer container 9 in a manner such that 50% to 100% in a heightwise direction of the external diametric or cross-sectional profile of each of the bladed members 15*b* and 16*b* of the first and second agitating/conveying members 15 and 16 is covered with the developer.

Another Embodiment of the Invention

Figure 5:
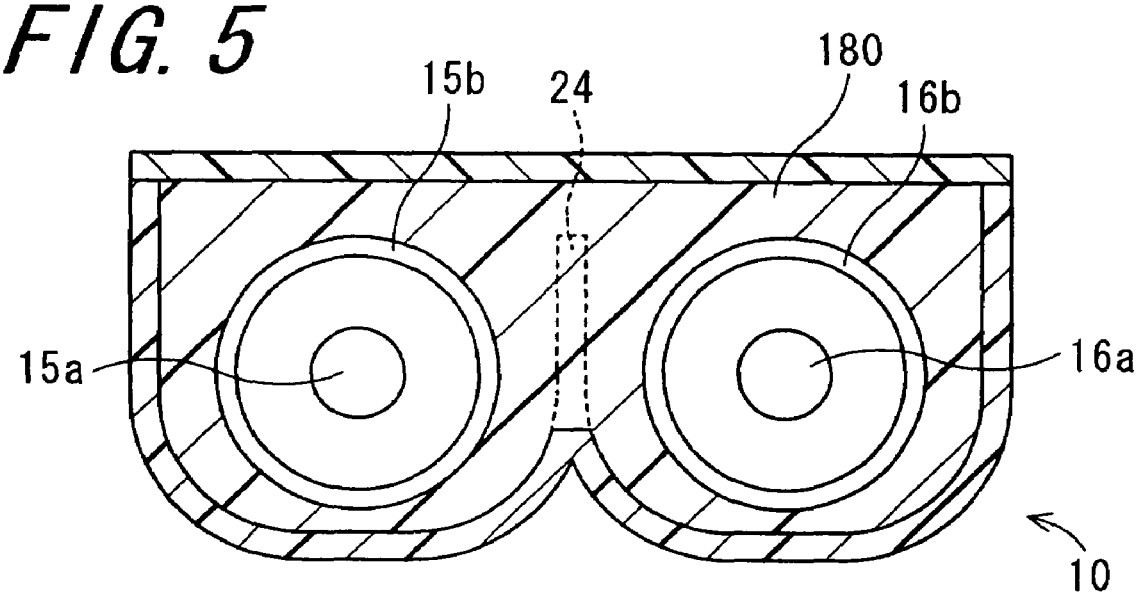
FIG. 5 is a sectional view of assistance in explaining another embodiment of the developer-flow blocking plate of the invention.

In the developing apparatus 10 set forth hereinabove, as has already been explained with reference to FIG. 4, the developer-flow blocking plate 18 is so shaped as to cover approximately one-half of the bladed member 15*b* of the first agitating/conveying member 15 and one-half of the bladed member 16*b* of the second agitating/conveying member 16 that are adjacent to each other. However, the developer-flow blocking plate 18 is not limited to this configuration, but may be of another configuration such as shown in FIG. 5. FIG. 5 shows a developer-flow blocking plate 180 constructed by forming two circular (hole-like) openings in a base platy member which is so disposed as to cover substantially the entire cross-sectional region of the developing apparatus 10. The openings are made larger than the projected external diametric or cross-sectional profile of the bladed member 15*b* and that of the bladed member 16*b*, respectively.

Also in the developer-flow blocking plate 180 thus constructed, the developer being conveyed by the agitating/conveying member 15, 16 is partly stemmed by the developer-flow blocking plate 180, thereby producing the dividedly agitated effect. Moreover, by varying the size of the opening, namely the diameter of the opening with respect to the axis of the bladed member, it is possible to make an adjustment to the amount of developer to be conveyed.

Accordingly, the developer-flow blocking plate 180 shown in FIG. 5 provides the same conveyance, mixing, and agitation effects as achieved by the developer-flow blocking plate 18 shown in FIG. 4.

Moreover, in the above description, the partition wall 12, 24 and the developer-flow blocking plate 18, 180 are illustrated as being disposed so as to stand upright at the bottom of the developer container 9. In this regard, the partition wall 12, 24 and the developer-flow blocking plate 18, 180 can be formed either integrally with or independently of the developer container 9. In the latter case, they are fixed at the bottom of the developer container 9 after the completion of assembly of the developer container 9.

Figure 6:
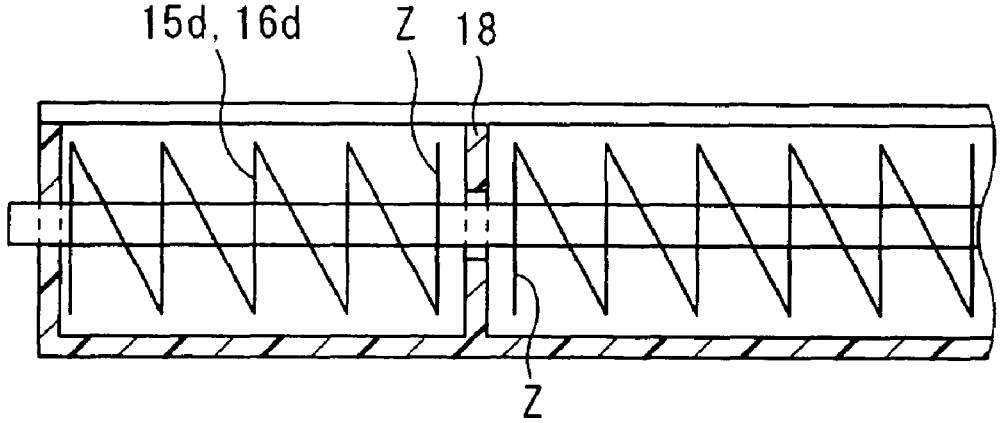
FIG. 6 is a sectional view showing an example of the configuration of an agitating/conveying member in part around the developer-flow blocking plate.

FIG. 6 shows a case where the first and second agitating/conveying members 15 and 16 are provided with spiral screws 15*d* and 16*d*, respectively, as agitating members. Although the screw 15*d*, 16*d* usually has a continuous structure, just as in the case of imparting the aforementioned blade absent area to the bladed members 15*b* and 16*b*, the screw 15*d*, 16*d* has a discontinuity at a position Z opposed to the developer-flow blocking plate 18.

Note that the use of the developer-flow blocking plate 180 as shown in FIG. 5 eliminates the need to secure the blade or screw-portion absent area on the agitating/conveying member 15, 16. That is, by making the opening of the developer-flow blocking plate 180 larger than the projected external diametric or cross-sectional profile of the bladed member 15*b*, 16*b* or the screw 15*d*, 16*d* provided as an agitating member, the bladed member 15*b*, 16*b* or the screw 15*d*, 16*d* can be formed in a continuous structure without the necessity of giving consideration to the placement of the developer-flow blocking plate.

EXAMPLE

In order to make sure the advantages of the structure of the developing apparatus 10 embodying the invention, an example was fabricated as follows to carry out experiments as to agitation conditions of supplied toner and so forth.

In the example, the developer 2 is composed of negatively charged toner having an average particle size (weight average particle size) of 6.5 μm and magnetic carrier having an average particle size (volume average particle size) of 45 μm, the saturation magnetization of which is set at 70 emu/cm$^3$.

The developing sleeve 11*a* of the developing roller 11 is formed of a stainless-steel sleeve having an external diameter of 25 mm. From the standpoint of expediting developer conveyance, it is preferable that a surface of the developing sleeve 11*a* contain asperities as appropriate. Therefore, the developing sleeve 11*a* is subjected to a blasting process to obtain a surface roughness in a range of approximately from 5 to 10 μm in terms of ten-point average roughness (Rz) according to JIS B 0601.

The rotational speed of the developing sleeve 11*a* is set at 510 rpm. The developing sleeve 11*a* has an axial length of 324 mm.

The first and second agitating/conveying members 15 and 16 are adjusted to rotate at 250 rpm in the arrow-indicated different directions as shown in FIG. 2. Instead of the bladed members 15 and 16*b*, screws are used to constitute the first and second agitating/conveying members 15 and 16. The pitch and the projected external diameter of the screw are set at 25 mm and 20 mm, respectively.

The amount of developer to be charged into the developer container 9 of the developing apparatus 10 thus constructed is adjusted in a manner such that 70% of the projected external diametric or cross-sectional profile of the screw member, namely the agitating member is covered with the developer. The concentration of toner contained in the charged developer is set at 7% by weight.

Moreover, toner is supplied into the extended developer conveyance section 21 of the extension region 20 in a manner such that the developer has a toner concentration of 9% by weight in the extension region 20.

The first and second agitating/conveying members 15 and 16 are driven to rotate at the aforementioned rotational speed so as for the developer 2 to be conveyed in the first and second developer conveyance sections 13 and 14 as well as in the first and second extended developer conveyance sections 21 and 22. At this time, variation in the toner concentration of the developer 2 are checked.

Variation in the toner concentration of the developer 2 was checked as follows. As shown in FIG. 3, there are provided four check points: a point A located 30 mm away from the upstream end of the developing sleeve 11*a* as seen along the direction in which the developer 2 is conveyed and supplied to the developing sleeve 11*a* by the first agitating/conveying member 15; a point B located 110 mm away from the upstream end; a point C located 190 mm away from the upstream end; and a point D located 270 mm away from the upstream end. In the individual check points, exactly 3 seconds, 9 seconds, 15 seconds, 20 seconds, 25 seconds, and 30 seconds into the developer conveyance, respectively, regular toner concentration checks are made to examine a toner concentration variation σ.

Figure 7:
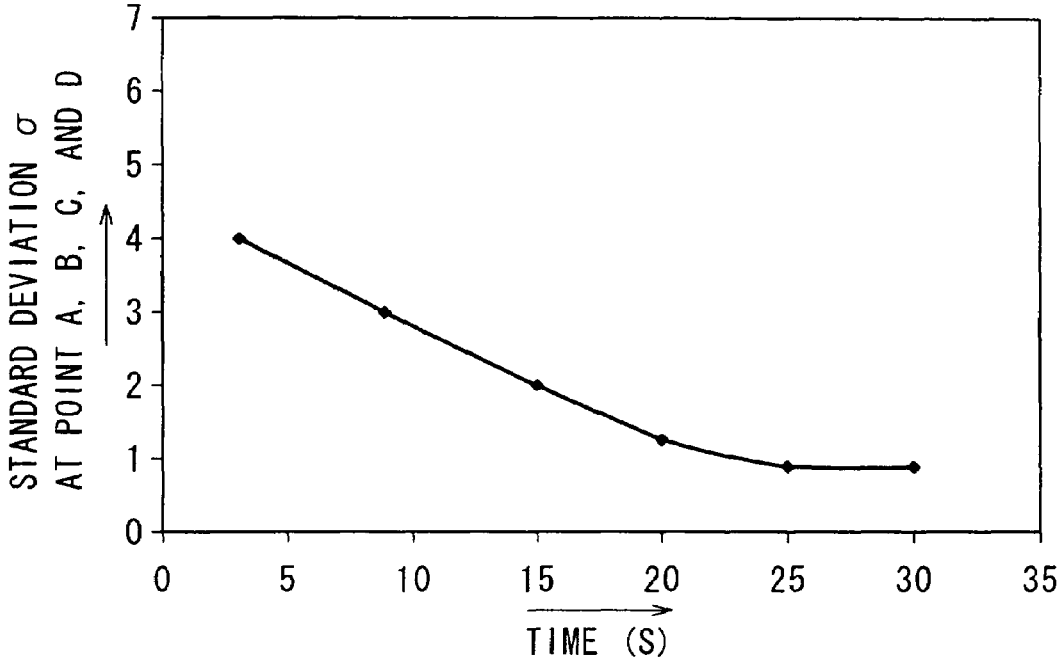
FIG. 7 is a characteristic chart, indicating the mixing status of toner in the developing apparatus of the invention, on which the abscissa represents mixing duration and the ordinate represents toner concentration variation σ.

If the variation σ is found to be small and remain substantially invariant in a short period of time, this will prove the excellence in agitation capability of the developing apparatus 10 embodying the invention. FIG. 7 shows the result of the variation examination performed thereon.

COMPARATIVE EXAMPLE

Figure 10:
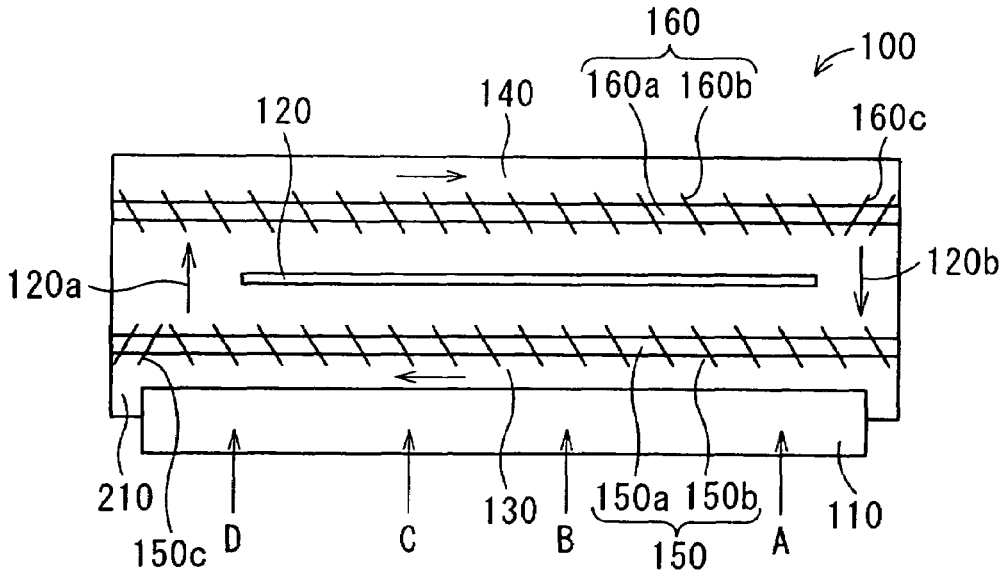
FIG. 10 is a plan view showing the structure of the developing apparatus according to the related art.

Next, there was obtained an experimental apparatus designed in conformity with the developing apparatus 100 which has been described as a prior art practice with reference to FIG. 10 to make performance comparisons between the developing apparatus 10 of the invention and the developing apparatus 100 of conventional design. The developing apparatus 100, namely the comparative example and the developing apparatus 10, namely the implementation example are identical in the configuration of the developing roller, especially the developing sleeve; the configurations of the first and second agitating/conveying members; and the configuration of the developer container. That is, the comparative example has basically the same structure as that of the implementation example, except for the absence of the extension region 20. Correspondingly, the position of toner supply is set in the vicinity of the downstream end portion of the apparatus as seen along the direction in which the developer is conveyed by the first agitating/conveying member 150, particularly set in a region 210 where the developer is shifted from the first developer conveyance section 130 to the second developer conveyance section 140.

Figure 8:
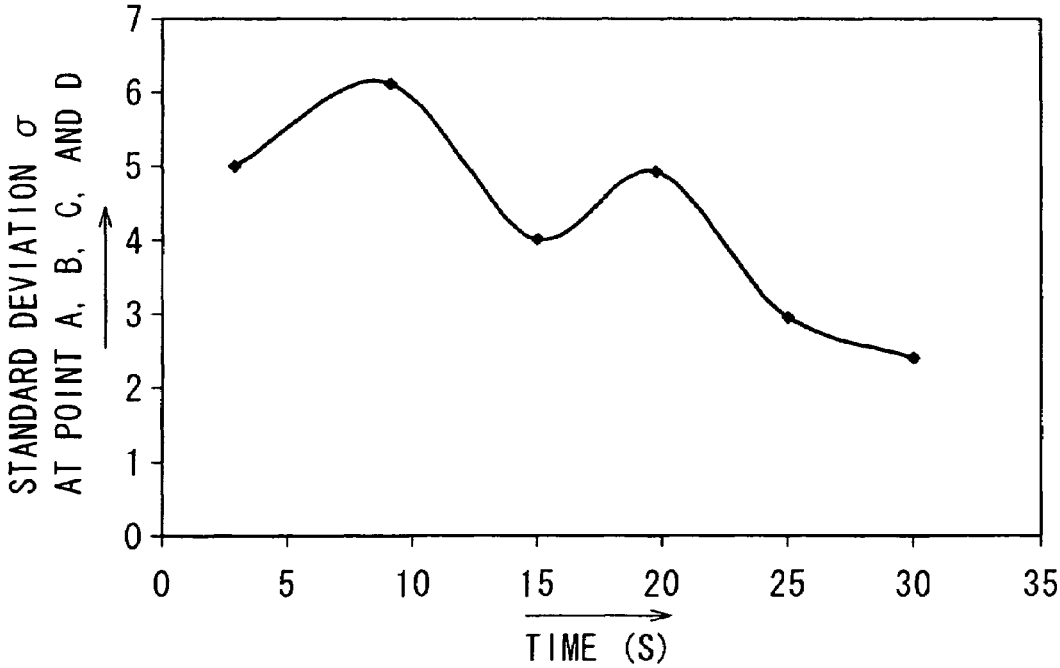
FIG. 8 is a characteristic chart, indicating the mixing status of toner in a developing apparatus of conventional design, on which the abscissa represents mixing duration and the ordinate represents toner concentration variation σ.
Figure 9:
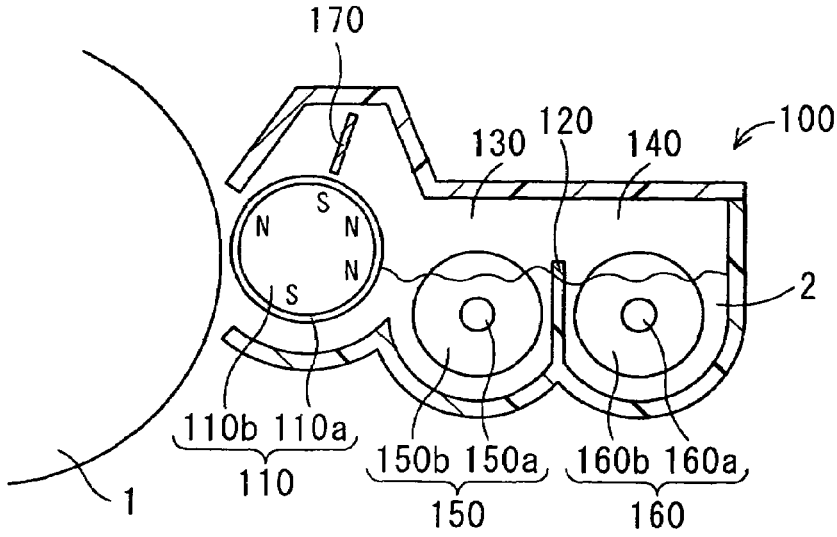
FIG. 9 is a sectional view showing the structure of a developing apparatus according to the related art.

Also in the comparative example were provided the check points A through D to measure the toner concentration variation. The measurement result is shown in FIG. 8.

Note that the variation (standard deviation) σ is represented by the square root of the differences of the respective data from the mean value of numerical data, which are squared and divided by the number of data. It is thus given by the following formula:

$$\sigma = \sqrt{\frac{1}{N}\sum_{k=1}^{N}(x_k - \bar{x})^2} \qquad \text{Formula (1)}$$

In the formula (1), N represents the number of data and $x_k$ represents a data value. In conclusion, as will be understood from FIGS. 7 and 8, according to the developing apparatus of the invention, the supplied toner was swiftly dispersed in the entire developer 2 with uniformity, and the toner concentration values measured at the points A through D were on the rise at substantially a constant pace. By way of contrast, according to the conventional developing apparatus as shown in FIG. 10, appreciable variation in toner concentration was observed at the points A through D.

Hence, in the developing apparatus 10 of the invention, it has been confirmed that the toner particles of supplied toner can be distributed substantially evenly on the surface of the developing roller 11 in the axial direction thereof. That is, the developing apparatus 10 of the invention offers excellent toner dispersibility. Moreover, since the supplied toner can be mixed and agitated with the developer thoroughly while being dispersed, it follows that the toner can be electrically charged satisfactorily.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus comprising:

a developer container for housing therein a developer having toner and carrier;

a developer carrying body for holding the developer; and an agitating/conveying member for conveying the developer in circulation along a rotary axis of the developer carrying body with agitation;

wherein the developer container includes a development region facing the developer carrying body and an extension region formed adjacent in the direction of the developer carrying body in the development region, and wherein the developer container has a developer-flow blocking plate acting as a partition between the development region and the extension region.

2. The developing apparatus of claim 1, wherein the development region and the extension region separated by the developer-flow blocking plate are provided with the agitating/conveying member for conveying the developer in circulation.

3. The developing apparatus of claim 2, wherein the agitating/conveying member is provided integrally through the development region and the extension region.

4. The developing apparatus of claim 3, wherein two agitating/conveying members for conveying the developer in opposite directions each other are provided in order to convey the developer in circulation, wherein a partition wall is provided between the agitating/conveying members in each of the development region and the extension region, and wherein the agitating/conveying members convey the developer in opposite directions each other along the partition wall so that the developer is circulated.

5. The developing apparatus of claim 4, wherein the agitating/conveying member is provided with an agitating member in a spiral configuration.

6. The developing apparatus of claim 4, wherein one end of the developer-flow blocking plate is located inwardly of an outer periphery of one agitating/conveying member, and another end of the developer-flow blocking plate is located inwardly of an outer periphery of another agitating/conveying member.

7. The developing apparatus of claim 4, wherein the developer-flow blocking plate has an opening through which the agitating/conveying member extends, and the opening is formed so as to have an inner diameter thereof larger than an outer diameter of the agitating/conveying member.

8. The developing apparatus of claim 1, wherein a toner supply unit is provided on the developer container at a position corresponding to the extension region.

9. The developing apparatus of claim 1, wherein the extension region is located downstream of a direction in which the developer is conveyed by the agitating/conveying member facing the developer carrying body.

10. An image forming apparatus having the developing apparatus of claim 1.

* * * * *